US008547281B2

(12) United States Patent
Ryou et al.

(10) Patent No.: US 8,547,281 B2
(45) Date of Patent: Oct. 1, 2013

(54) METAMATERIAL ANTENNA USING A MAGNETO-DIELECTRIC MATERIAL

(75) Inventors: Byung Hoon Ryou, Seoul (KR); Won Mo Sung, Siheung-si (KR); Kyung Duk Jang, Daegu (KR); Wee Sang Park, Gyeongbuk (KR)

(73) Assignees: EMW Co., Ltd., Incheon (KR); Pohang University of Science Industry-Academy Cooperation, Gyungbuk (KR)

( * ) Notice: Subject to any disclaimer, the term of this patent is extended or adjusted under 35 U.S.C. 154(b) by 429 days.

(21) Appl. No.: 12/919,728

(22) PCT Filed: Feb. 3, 2009

(86) PCT No.: PCT/KR2009/000520

§ 371 (c)(1),
(2), (4) Date: Mar. 21, 2011

(87) PCT Pub. No.: WO2009/104872

PCT Pub. Date: Aug. 27, 2009

(65) Prior Publication Data

US 2011/0187601 A1 Aug. 4, 2011

(30) Foreign Application Priority Data

Feb. 20, 2008 (KR) ..... 10-2008-0015244

(51) Int. Cl.
*H01Q 1/38* (2006.01)

(52) U.S. Cl.
USPC ..... 343/700 MS; 343/749; 343/909

(58) Field of Classification Search
USPC ..... 343/700 MS, 749, 754, 909
See application file for complete search history.

(56) References Cited

U.S. PATENT DOCUMENTS

| | | | | |
|---|---|---|---|---|
| 7,446,712 | B2 * | 11/2008 | Itoh et al. | 343/700 MS |
| 7,592,957 | B2 * | 9/2009 | Achour et al. | 343/700 MS |
| 7,911,386 | B1 * | 3/2011 | Itoh et al. | 343/700 MS |
| 7,952,526 | B2 * | 5/2011 | Lee et al. | 343/700 MS |
| 2006/0066422 | A1 | 3/2006 | Itoh et al. | |
| 2007/0176827 | A1 | 8/2007 | Itoh et al. | |

OTHER PUBLICATIONS

PCT International Search Report for PCT Counterpart Application No. PCT/KR2009/000520 containing Communication relating to the Results of the Partial International Search Report, 2 pgs., (Apr. 8, 2009).

Mikko Kärkkäinen, et al., "Patch Antenna with Stacked Split-Ring Resonators as an Artificial Magneto-Dielectric Substrate", Microwave and Optical Technology Letters, vol. 46, Issue 6, pp. 554-556, (Sep. 20, 2005).

Soon-Soo Oh, et al., "Artificial Magnetic Conductor using Split Ring Resonators and its Applications to Antennas", Microwave and Optical Technology Letters, vol. 48, Issue 2, pp. 329-334, (Feb. 2006).

* cited by examiner

*Primary Examiner* — Hoang V Nguyen
(74) *Attorney, Agent, or Firm* — The PL Law Group, PLLC

(57) ABSTRACT

The invention relates to the size reduction of an antenna using a magneto-dielectric material for a CRLH-TL (Composite Right/Left Handed Transmission Line) antenna. In particular, the invention provides a small and low profile metamaterial antenna attained by performing SRR (Split Ring Resonator) magnetization on a dielectric material and applying the magneto-dielectric material to the CRLH-TL antenna that is composed of patches and vias. Even further, the invention provides a metamaterial antenna using a magneto-dielectric material, the antenna comprising: a substrate which is made up of a magneto-dielectric material and which has an SRR structure inserted thereto; patches with a CRLH-TL structure formed at a predetermined distance above the substrate; and a ground plane formed at a predetermined distance below the substrate.

9 Claims, 8 Drawing Sheets

(a) (b)

(a) (b)

METAMATERIAL ANTENNA USING A MAGNETO-DIELECTRIC MATERIAL

CROSS-REFERENCE TO RELATED APPLICATIONS

This patent application is a U.S. National Phase application under 35 U.S.C. §371 of International Application No. PCT/KR2009/000520, filed on Feb. 3, 2009, entitled METAMATERIAL ANTENNA USING A MAGNETO-DIELECTRIC MATERIAL, which claims priority to Korean patent application number 10-2008-0015244, filed Feb. 20, 2008.

TECHNICAL FIELD

The present invention relates to a reduction in the size of an antenna using a magneto-dielectric material in a CRLH-TL antenna. More particularly, the present invention relates to a metamaterial antenna using a magneto-dielectric material, which is capable of reducing the size by magnetizing a dielectric material using an SRR in a CRLH-TL antenna implemented using a patch and vias.

BACKGROUND ART

Recently, active research is being done on the design of an antenna using a metamaterial. The metamaterial indicates material which has a specific unit structure periodically arranged and an electromagnetic property not existing in the natural world.

From among several kinds of metamaterials, a metamaterial having a randomly controllable dielectric constant magnetic permeability has been in the spotlight. Representatively, a material called 'Negative Refractive Index (NRI)' or 'Left-Handed Material (LHM)' has both the valid dielectric constant and the magnetic permeability of a negative value and complies with the left hand rule in the electric field, the magnetic field, and the electric wave traveling direction. If the metamaterial is applied to an antenna, the performance of the antenna is improved by the characteristics of the metamaterial.

A metamaterial structure applied to an antenna representatively includes a Composite Right/Left Handed Transmission Line (CRLH-TL) structure. A 0-th order resonant mode (i.e., one of the characteristics of the structure) is a resonant mode in which the propagation constant becomes 0. In the 0-th order resonant mode, the wavelength becomes infinite, and no phase delay according to the transmission of electric waves is generated. The resonant frequency of this mode is determined by the parameters of the CRLH-TL structure and thus very advantageous in a reduction in the size of an antenna because it does not depend on the length of the antenna.

Of course, an antenna can be made using a first order resonant mode. In this case, the antenna can be designed to have a very low resonant frequency, while having the same radiation pattern as a common patch antenna.

Recently, there is a growing interest in a magneto-dielectric material capable of increasing the magnetic permeability. As a conventional method of decreasing the size of an antenna, there is a method using a substrate of a high dielectric constant. However, the method is disadvantageous in that the efficiency of an antenna is reduced and the bandwidth is narrowed because energy is confined in the substrate of a high dielectric constant. Meanwhile, if a substrate having a high magnetic permeability is used, the above problems can be solved and also the antenna can be reduced in size.

In order to fabricate the magneto-dielectric material, a metal structure responding to an external magnetic field is inserted into a common substrate. A Split Ring Resonator (SRR) is chiefly used as the structure. Current is induced into the SRR by an external magnetic field, and a magnetic field is generated by the induced current. Accordingly, the magnetic permeability is changed in response to the external magnetic field. The magnetic permeability has a resonating characteristic. The magnetic permeability is 1 or higher in a band under a resonant frequency, a negative value between the resonant frequency and a plasma frequency, and a positive value 1 or fewer over the plasma frequency. The band used as the magneto-dielectric material is a region under the resonant frequency.

SUMMARY

The present invention has been made in view of the above problems occurring in the prior art, and an object of the present invention is to provide a reduction in the size of an antenna using a magneto-dielectric material in a CRLH-TL antenna, and more particularly, a metamaterial antenna using a magneto-dielectric material, which is capable of reducing the size by magnetizing a dielectric material using an SRR in a CRLH-TL antenna implemented using a patch and vias.

To achieve the above object, the present invention provides a metamaterial antenna using a magneto-dielectric material, comprising a substrate into which SRR (Split Ring Resonator) structures are inserted and in which the magneto-dielectric material is implemented; a patch of a CRLH-TL (Composite Right/Left Handed Transmission Line) structure, spaced apart from the substrate at a specific interval and formed on the upper side of the substrate; and a ground spaced apart from the substrate at a specific interval and formed on the lower side of the substrate.

Preferably, the magneto-dielectric material in which the substrate, the patch, and the ground are interconnected through vias is used.

Furthermore, the substrate comprises the SRR structures having two unit cells, and one unit cell of the SRR structures comprises eight SRRs radially disposed.

Furthermore, one unit cell of the SRR structures comprises six first SRR of a relatively long length radially, disposed in a longitudinal direction of the substrate 200, and second SRRs of a short length, disposed in a horizontal direction of the substrate 200. The first and second SRRs are formed to face each other on the upper and lower sides of the substrate.

Furthermore, both ends of the first and second SRRs formed to face each other on the upper and lower sides of the substrate are interconnected through vias penetrating the substrate.

Furthermore, a slot is formed at the central portion of the first and second SRRs formed on the lower side of the substrate.

Furthermore, the patch is an antenna of the CRLH-TL structure including two unit cells.

Furthermore, the patch is spaced apart from a microstrip line (i.e., a feed line) at a specific interval, coupled therewith, and supplied with power.

Furthermore, the present invention provides a wireless communication terminal including the metamaterial antenna.

As described above, the present invention relates to a reduction in the size of an antenna using a magneto-dielectric material in a CRLH-TL antenna. More particularly, the present invention can provide a metamaterial antenna using a magneto-dielectric material, which is capable of reducing the size by magnetizing a dielectric material using an SRR in a CRLH-TL antenna implemented using a patch and vias.

DETAILED DESCRIPTION

In order to fully understand the present invention, operational advantages of the present invention, and the object achieved by implementations of the present invention, reference should be made to the accompanying drawings illustrating preferred embodiments of the present invention and to the contents described in the accompanying drawings.

Hereinafter, the preferred embodiments of the present invention are described in detail with reference to the accompanying drawings. The same reference numbers are used throughout the drawings to refer to the same parts.

Figure 1:
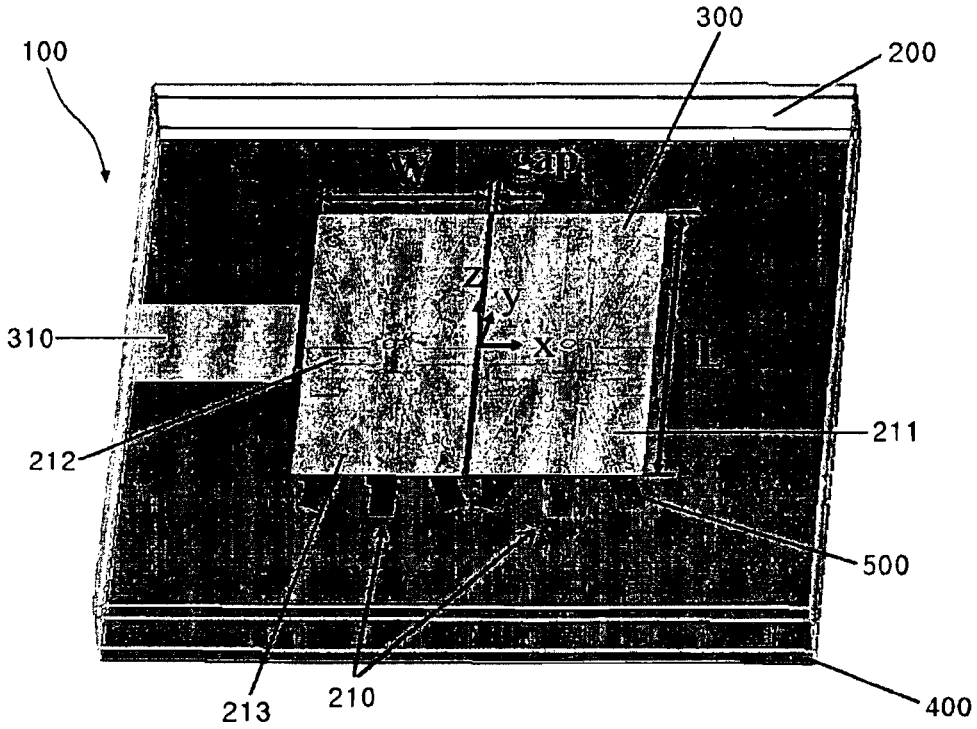
FIG. 1 is a diagram showing a metamaterial antenna using a magneto-dielectric material according to a preferred embodiment of the present invention.

FIG. 1 is a diagram showing a metamaterial antenna using a magneto-dielectric material according to a preferred embodiment of the present invention.

Referring to FIG. 1, in the metamaterial antenna 100 of a CRLH-TL structure of the present invention, a magneto-dielectric material formed using SRR (Split Ring Resonator) structures 210 is used as a substrate 200, and a patch 300 is formed on the substrate 200.

More particularly, the metamaterial antenna 100 includes three layers. The patch 300 is formed on the highest layer, and the SRR structures 210 are formed in the middle layer using both the upper and lower sides of the substrate 200. The lowest layer is operated as a ground 400, and the three layers are interconnected through vias 500.

The patch 300 is a CRLH-TL antenna implemented using two unit cells. Eight SRRs 211 and 212 per unit cell are formed at the bottom of the patch 300, thus forming the SRR structure 210 and magnetizing a dielectric material. The dielectric material is used as the substrate 200.

The dimensions of the metamaterial antenna 100 were L=25 mm, W=12.4 mm, and gap=0.2 mm. The radius of the via was 0.3 mm. The substrate was formed of Rogers RT/duroid 5880 substrate. The thickness of the upper and lower substrates was 1.55 mm (62 mil), the thickness of the middle substrate was 0.508 mm (20 mil), and the dimensions of the substrate was 55 mm in length and breadth. The antenna is supplied with power through a microstrip line 310 of 8 mm in width.

Figure 2:
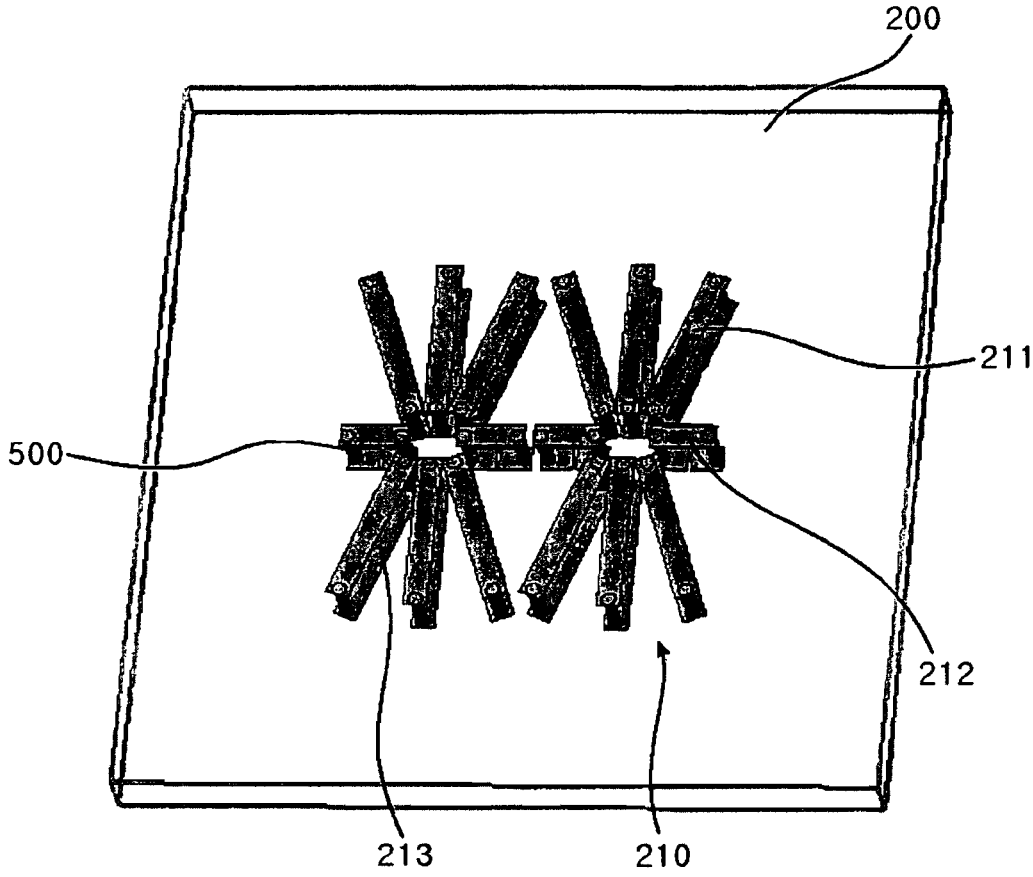
FIG. 2 is a diagram showing a substrate made of a magneto-dielectric material according to a preferred embodiment of the present invention.
Figure 3:
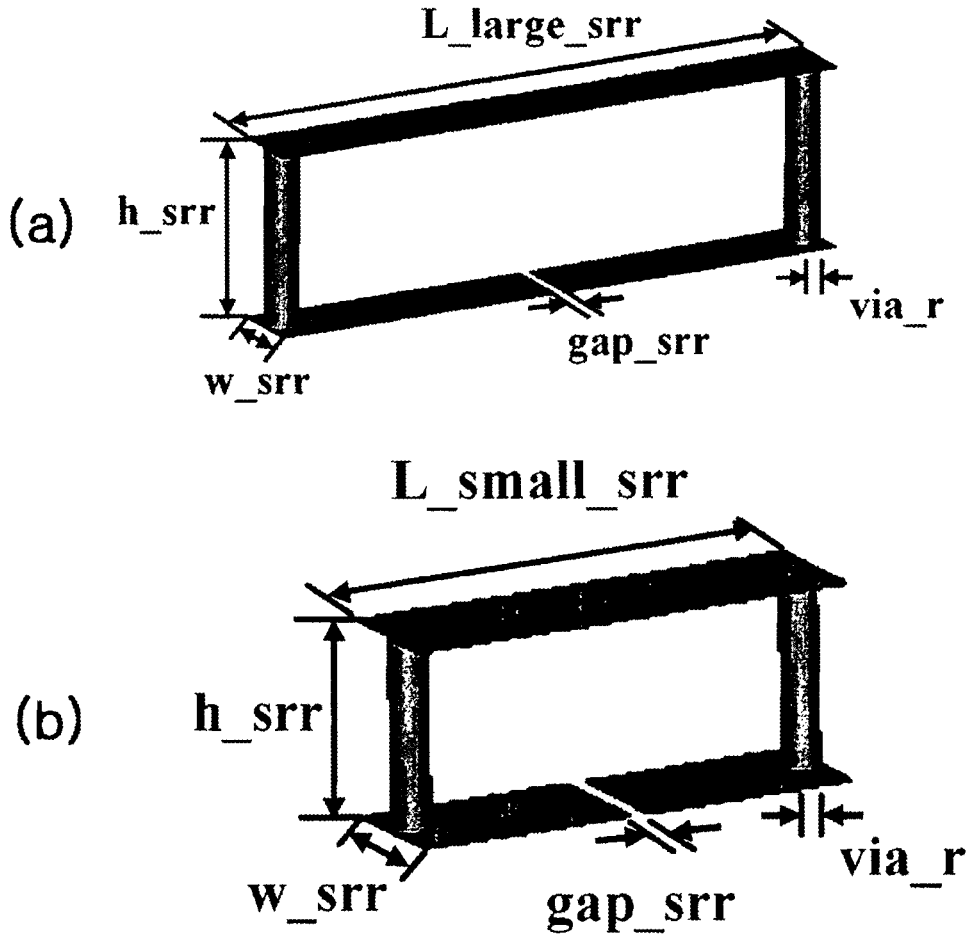
FIGS. 3(*a*) and 3(*b*) are diagrams showing SRR structures according to a preferred embodiment of the present invention.

FIG. 2 is a diagram showing a substrate made of a magneto-dielectric material according to a preferred embodiment of the present invention. FIG. 3 is a diagram showing the SRR structures according to a preferred embodiment of the present invention.

Referring to FIGS. 2 and 3, the SRR structure 210 includes a first SRR 211 having a relatively long length and a second SRR 212 having a short length. The 6 first SRRs 211 are radially disposed in the longitudinal direction of the substrate 200, and the second SRRs 212 are disposed in the horizontal direction of the substrate 200. FIG. 3(*a*) shows the structure of the first SRR 211, and FIG. 3(*b*) shows the structure of the second SRR 212.

The first and second SRRs 211 and 212 are symmetrically formed on the upper and lower sides of the substrate. Both ends of the SRRs 211 and 212, facing each other on the basis of the substrate, are interconnected through the vias 500 penetrating the substrate.

Meanwhile, a slot 213 is formed at the central portion of the first and second SRRs 211 and 212 formed on the lower side of the substrate.

The dimensions of the SRR were L_large_srr=11 mm, L_small_srr=4.5 mm, w_srr=2 mm, gap_srr=0.2 mm, h_srr=1.55 mm, and via_r=0.3 mm.

Figure 4:
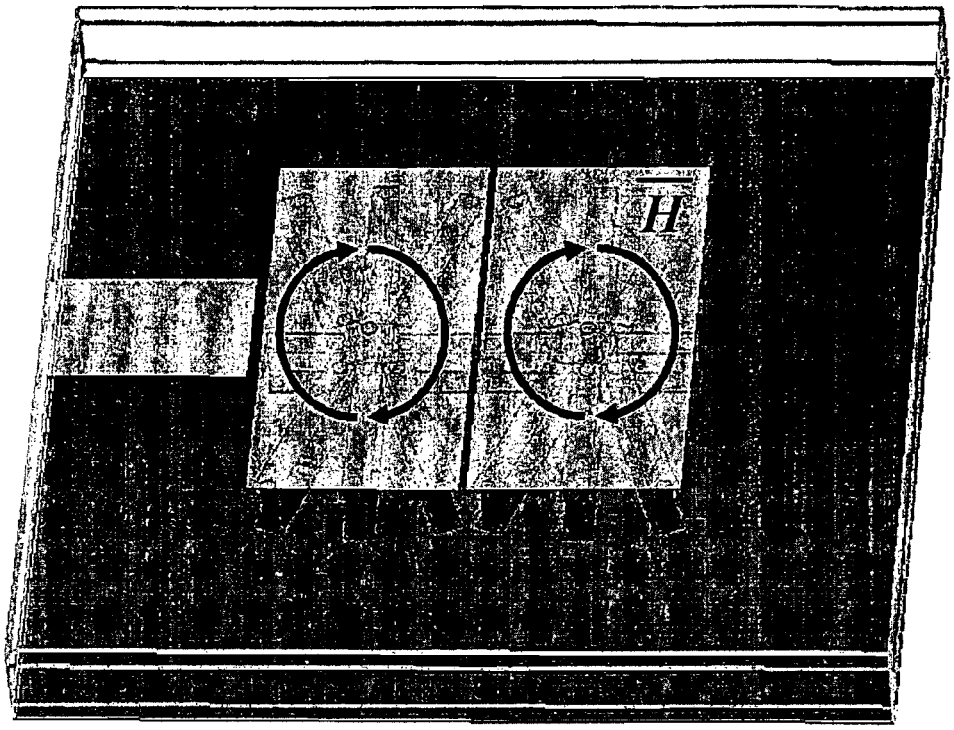
FIG. 4 is a diagram showing the direction in which a magnetic field is generated in the antenna according to the preferred embodiment of the present invention.

FIG. 4 is a diagram showing the direction in which a magnetic field is generated in the antenna according to the preferred embodiment of the present invention.

In order for the SRR structures 210 to respond to a magnetic field, the SRR structures 210 and the magnetic field need to be disposed vertically.

Referring to FIG. 4, in the CRLH-TL metamaterial antenna 100 implemented using the patch 300 and the vias 500, a magnetic field is formed in the direction in which the magnetic field is rotated around the via 500. Accordingly, it is effective to radially dispose the first and second SRRs 211 and 212 around the respective vias 500.

The operating characteristics of the SRR were checked through simulations. In the simulations, CST Microwave Studio 2006B was used.

Figure 5:
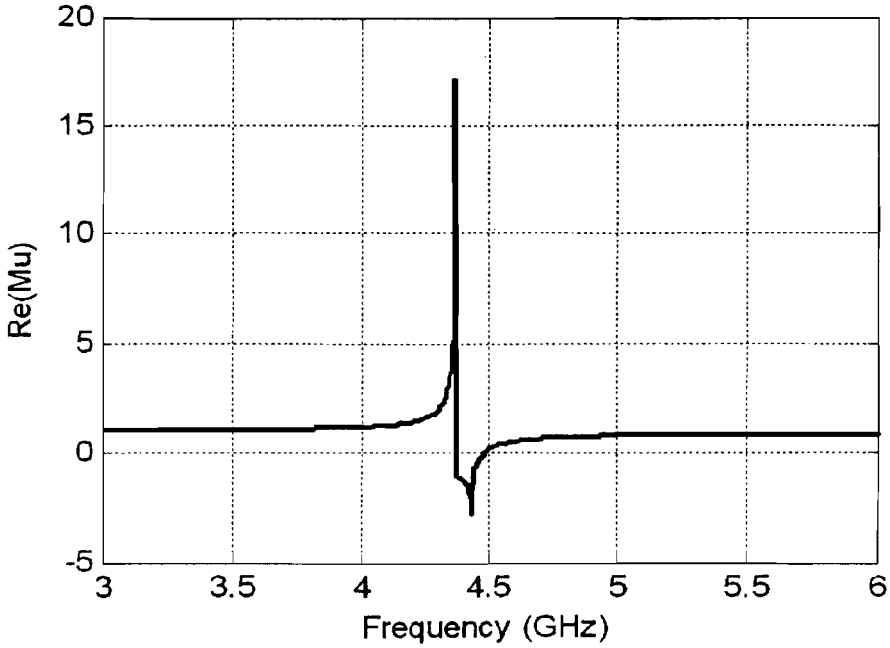
FIG. 5 is a diagram showing a change in the magnetic permeability according to the frequency of a first SRR according to a preferred embodiment of the present invention.

FIG. 5 is a diagram showing a change in the magnetic permeability according to the frequency of the first SRR according to a preferred embodiment of the present invention.

Referring to FIG. 5, the first SRR 211 showed a resonant characteristic at a frequency of 4.37 GHz. It was checked that in a frequency lower than the frequency 4.37 GHz, a magnetic permeability value was 1 or higher and in a frequency higher than the frequency 4.37 GHz, a magnetic permeability value became a negative number and was changed to a positive number smaller than 1. The range of a frequency used as a magneto-dielectric material is a frequency band lower than the resonant frequency of the SRR, and a magnetic permeability value is 1 or higher in the above frequency band.

Figure 6:
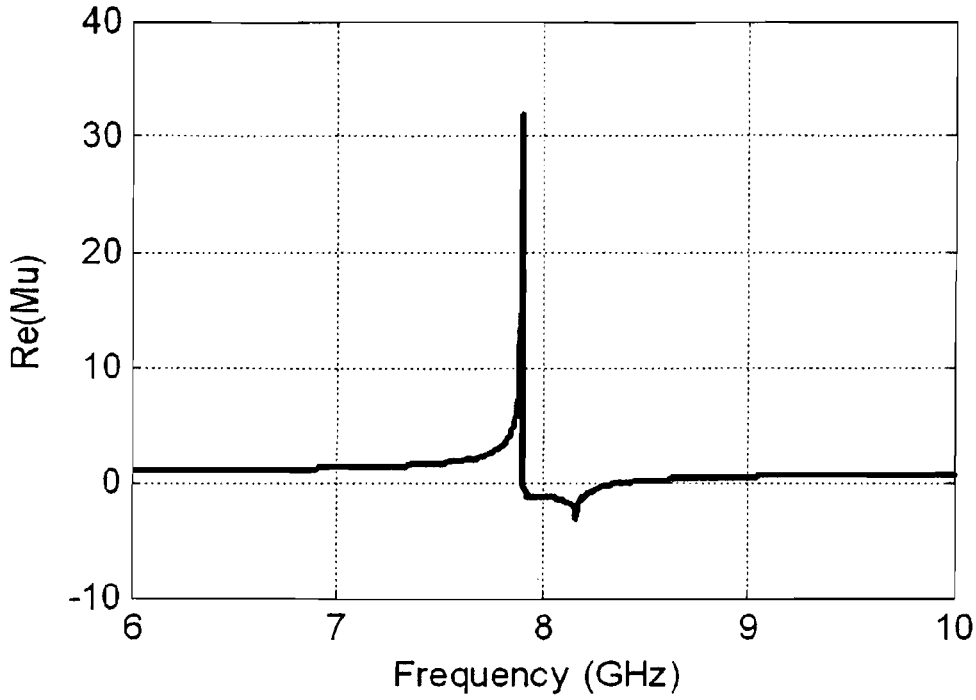
FIG. 6 is a diagram showing a change in the magnetic permeability according to the frequency of a second SRR according to a preferred embodiment of the present invention.

FIG. 6 is a diagram showing a change in the magnetic permeability according to the frequency of the second SRR according to a preferred embodiment of the present invention.

Referring to FIG. 6, the second SRR 212 showed a resonant characteristic at a frequency of 7.91 GHz, and a change in the magnetic permeability of the second SRR 212 was the same as that of the first SRR 211.

A change in the resonant frequency of the antenna was checked in the case in which the SRRs were not used in the CRLH-TL antenna and the case in which the SRRs were used in the CRLH-TL antenna. The patch 300 is spaced apart from the microstrip line 310 (i.e., a feed line) with a gap of 0.3 mm interposed therebetween, coupled with the microstrip line, and supplied with power.

TABLE 1

| Presence of SRR | $f_{-1}$ (GHz) | $f_0$ (GHz) |
|---|---|---|
| Yes | 1.4224 | 2.0604 |
| No | 1.3209 | 1.5674 |

From Table 1, it can be seen that the case in which the SRRs were used has a reduction both in the 0-th order resonant frequency and the −1-st order resonant frequency, as compared with the case in which the SRRs were not used. In the case of the 0-th order resonant mode, there was an effect of a reduction in the frequency of 23.9%. In the case in which the SRRs were not used, the dimensions of the antenna were $0.1717\lambda_0 \times 0.1717\lambda_0 \times 0.0176\lambda_0$ (where $\lambda_0$ is the wavelength in the free space). In the case in which the SRRs were used, the dimensions of the antenna were $0.1306\lambda_0 \times 0.1306\lambda_0 \times 0.0134\lambda_0$. Accordingly, there was an effect of a reduction in the area of about 42.14%.

Figure 7:
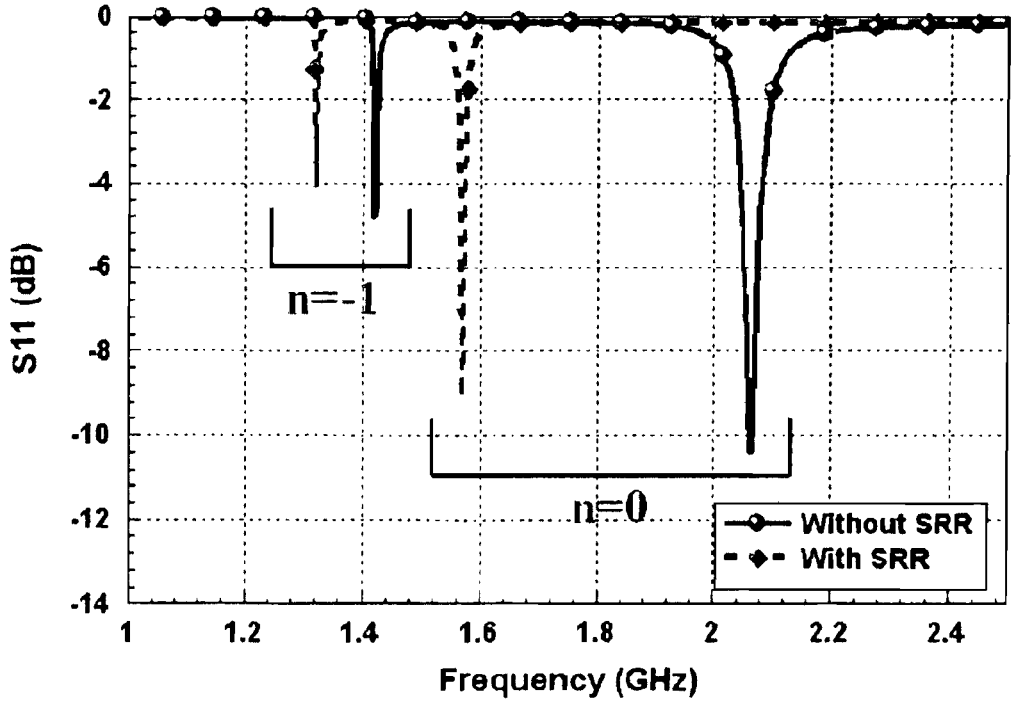
FIG. 7 is a graph showing a return loss depending on whether the SRRs are used.

FIG. 7 is a graph showing a return loss depending on whether the SRRs are used.

Figure 8:
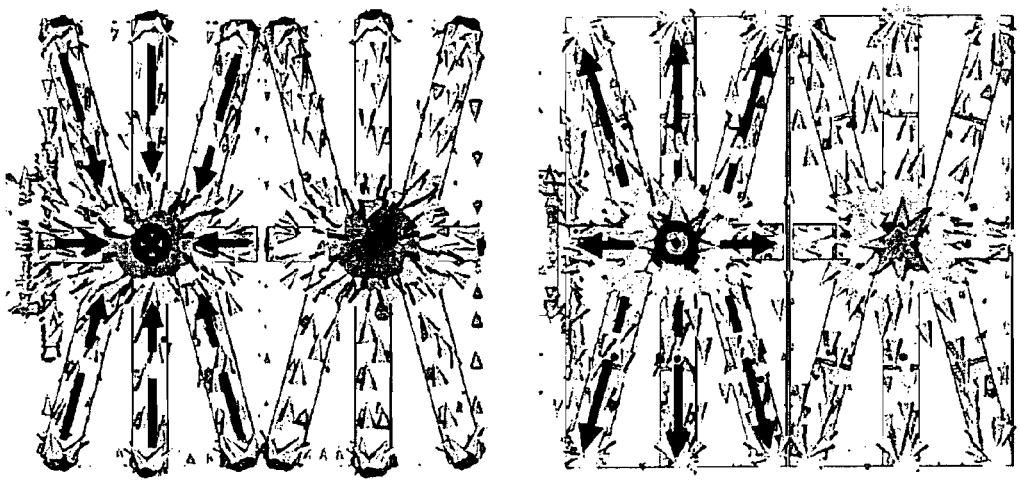
FIGS. 8(*a*) and 8(*b*) are diagrams showing the surface current of an SRR in a 0-th order resonant mode according to a preferred embodiment of the present invention.

FIG. 8 is a diagram showing the surface current of the SRRs in the 0-th order resonant mode according to a preferred embodiment of the present invention.

Figure 9:
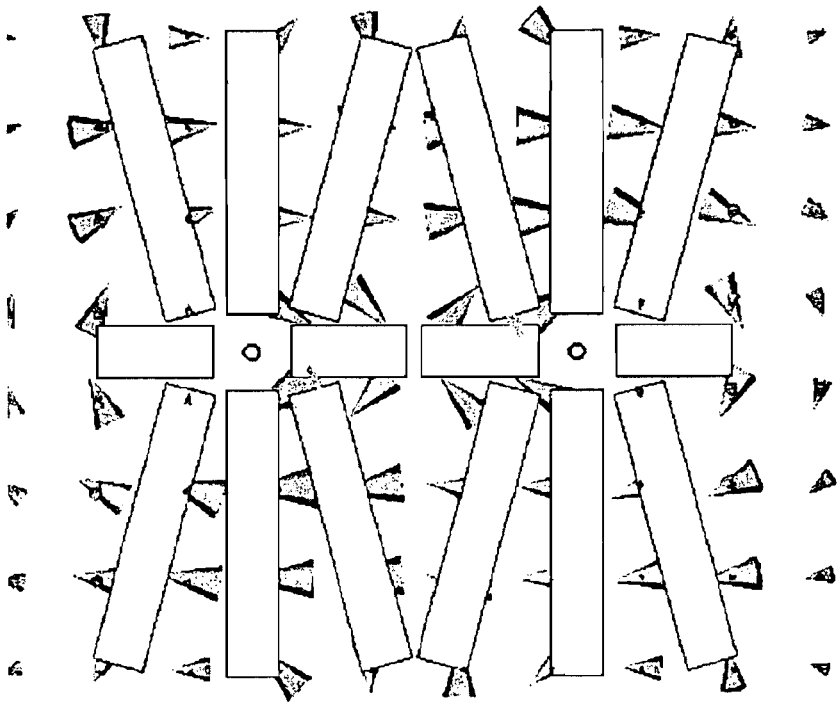
FIG. 9 is a diagram showing the direction of a magnetic field generated in the antenna according to the preferred embodiment of the present invention.

FIG. 8(*a*) shows current flowing into the upper side of the SRRs when seen from the top to the bottom, and FIG. 8(*b*) shows current flowing into the lower side of the SRRs when seen from the bottom to the top. Current in the via 500 is directed from the patch to the ground 400. When seen from the top to the bottom, the direction of a magnetic field is clockwise as shown in FIG. 9. At this time, in the direction of current flowing into the SRRs, it can be seen that the direction of a magnetic field generated by the SRRs will become the same as a magnetic field generated by the vias 500. Accordingly, the magnetic permeability is increased, but the resonant frequency of the antenna is reduced by an enhanced magnetic field.

Figure 10:
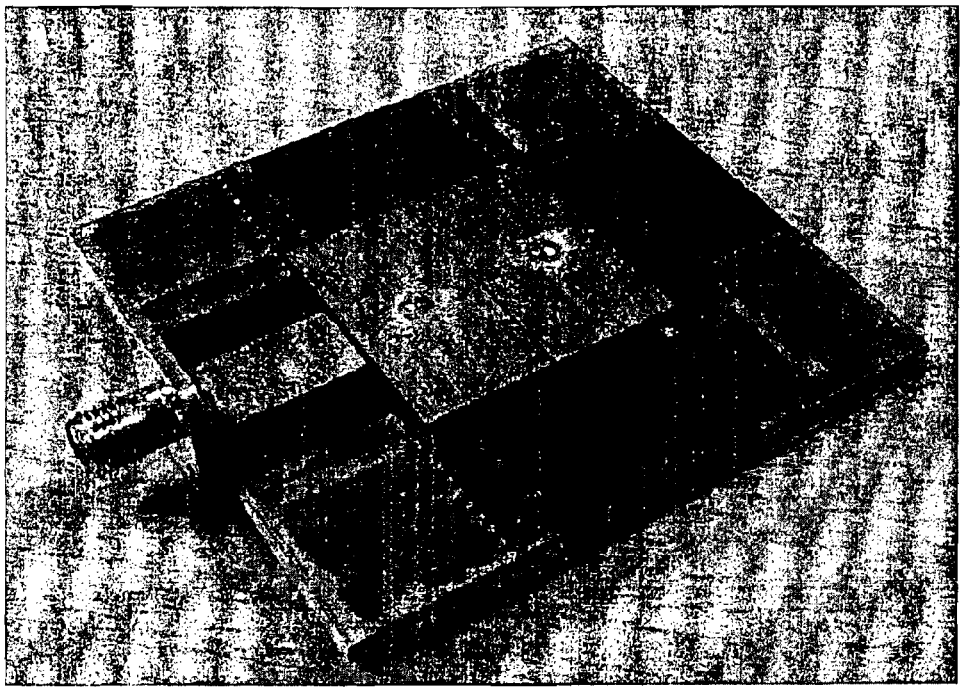
FIG. 10 is a photograph showing an antenna actually fabricated using the SRR structures according to the preferred embodiment of the present invention.

FIG. 10 is a photograph showing an antenna actually fabricated using the SRR structures according to the preferred embodiment of the present invention.

Referring to FIG. 10, the gap between the feed line and the patch 300 was set to 0.5 mm in order to match the antenna.

Figure 11:
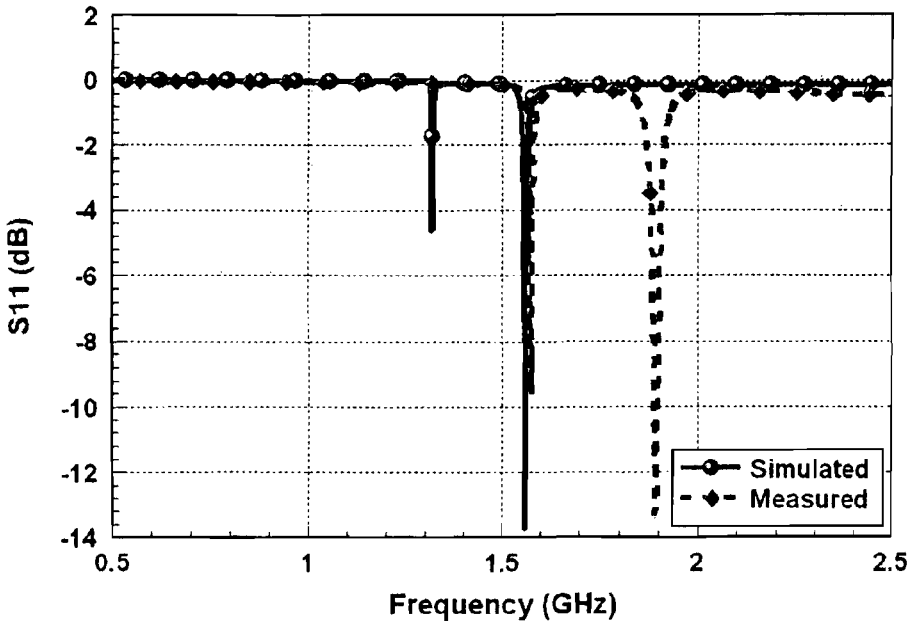
FIG. 11 is a graph showing a measured return loss of the actually fabricated antenna and a simulated return loss.

FIG. 11 is a graph showing a measured return loss of the actually fabricated antenna and a simulated return loss.

Referring to FIG. 11, there is slightly a difference between the simulation result and the measured return loss, which can be seen as error occurring in a process of fabricating the antenna. When the antenna is fabricated, the portion of the via 500 is slightly protruded because of the SRR structure having an upper and lower plane type, and thus an opening is formed between the substrates 200. It is determined that the error of a frequency band was generated in the return loss because of the error resulting from the opening. A measured bandwidth of the antenna was 1.883 to 1.892 GHz (0.48%).

Figure 12:
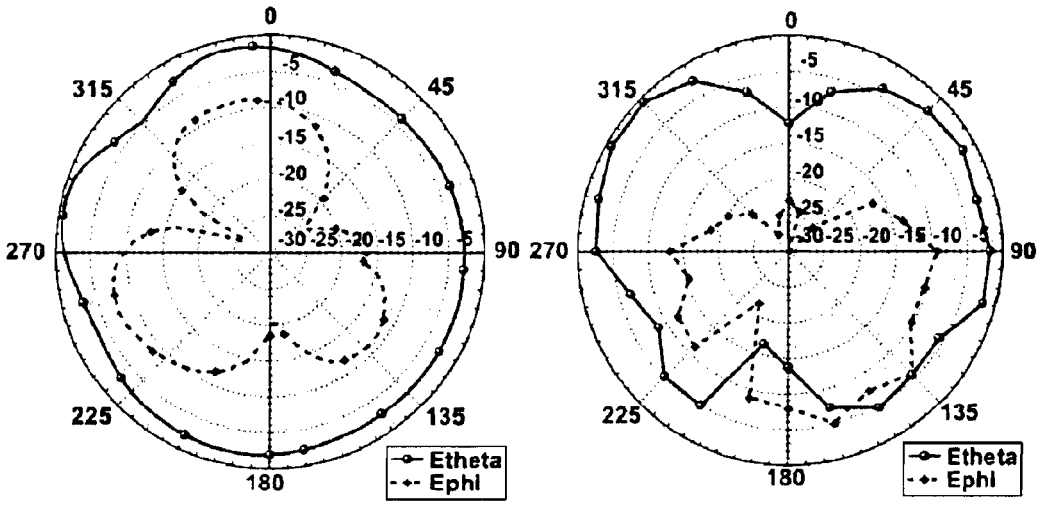
FIGS. 12(*a*) and 12(*b*) are diagrams showing a measured radiation pattern of the actually fabricated antenna.

FIG. 12 is a diagram showing a measured radiation pattern of the actually fabricated antenna.

FIG. 12(*a*) indicates an E-plane in an x-z plane, and FIG. 12(*b*) indicates an H-plane in the x-y plane.

The radiation pattern indicates a monopole radiation pattern which is the radiation pattern of a 0-th order resonant mode antenna. A measured gain of the antenna was 0.534 dBi, and measured efficiency thereof was 51.7%.

While an embodiment of the present invention has been described with reference to the accompanying drawings, the embodiment is only illustrative. Those skilled in the art will understand that a variety of modification and equivalent embodiments are possible from the present invention. Accordingly, a true technological protection range of the present invention should be defined by the technical spirit of the accompanying claims.

What is claimed is:

1. A metamaterial antenna using a magneto-dielectric material, comprising:

a substrate into which SRR (Split Ring Resonator) structures are inserted and in which the magneto-dielectric material is implemented;

a patch of a CRLH-TL (Composite Right/Left Handed Transmission Line) structure, spaced apart from the substrate at a specific interval and formed on an upper side of the substrate; and a ground spaced apart from the substrate at a specific interval and formed on a lower side of the substrate.

2. The metamaterial antenna according to claim 1, wherein the substrate, the patch, and the ground are interconnected through vias.

3. The metamaterial antenna according to claim 1, wherein:

the substrate comprises the SRR structures having two unit cells, and one unit cell of the SRR structures comprises eight SRRs radially disposed.

4. The metamaterial antenna according to claim 3, wherein:

one unit cell of the SRR structures comprises six first SRR of a relatively long length radially, disposed in a longitudinal direction of the substrate 200, and second SRRs of a short length, disposed in a horizontal direction of the substrate 200, and the first and second SRRs are formed to face each other on the upper and lower sides of the substrate.

5. The metamaterial antenna according to claim 4, wherein both ends of the first and second SRRs formed to face each other on the upper and lower sides of the substrate are interconnected through vias penetrating the substrate.

6. The metamaterial antenna according to claim 4, wherein a slot is formed at a central portion of the first and second SRRs formed on the lower side of the substrate.

7. The metamaterial antenna according to claim 1, wherein the patch is an antenna of the CRLH-TL structure including two unit cells.

8. The metamaterial antenna according to claim 1, wherein the patch is spaced apart from a microstrip line of a feed line at a specific interval, coupled with the microstrip line, and supplied with power.

9. A wireless communication terminal including a metamaterial antenna using a magneto-dielectric material, comprising:

a substrate into which SRR (Split Ring Resonator) structures are inserted and in which the magneto-dielectric material is implemented;

a patch of a CRLH-TL (Composite Right/Left Handed Transmission Line) structure, spaced apart from the substrate at a specific interval and formed on an upper side of the substrate; and a ground spaced apart from the substrate at a specific interval and formed on a lower side of the substrate.

* * * * *